US010201066B2

(12) United States Patent
Ekinci et al.

(10) Patent No.: US 10,201,066 B2
(45) Date of Patent: Feb. 5, 2019

(54) COMPACT LIGHT SOURCE FOR METROLOGY APPLICATIONS IN THE EUV RANGE

(71) Applicant: PAUL SCHERRER INSTITUT, Villigen PSI (CH)

(72) Inventors: Yasin Ekinci, Zurich (CH); Leonid Rivkin, Baden (CH); Albin Wrulich, Baden (CH); Andreas Streun, Schliengen (DE)

(73) Assignee: Paul Scherrer Institut, Villigen PSI (CH)

( * ) Notice: Subject to any disclaimer, the term of this patent is extended or adjusted under 35 U.S.C. 154(b) by 0 days.

(21) Appl. No.: 15/755,885

(22) PCT Filed: Aug. 22, 2016

(86) PCT No.: PCT/EP2016/069809
§ 371 (c)(1),
(2) Date: Feb. 27, 2018

(87) PCT Pub. No.: WO2017/036840
PCT Pub. Date: Mar. 9, 2017

(65) Prior Publication Data

US 2018/0249568 A1 Aug. 30, 2018

(30) Foreign Application Priority Data

Aug. 28, 2015 (EP) ..... 15182848

(51) Int. Cl.
*H05G 2/00* (2006.01)
*H05H 7/08* (2006.01)
(Continued)

(52) U.S. Cl.
CPC ..... *H05G 2/00* (2013.01); *H05H 7/04* (2013.01); *H05H 7/08* (2013.01); *H05H 7/10* (2013.01); *H05H 13/04* (2013.01)

(58) Field of Classification Search
CPC .. H05G 2/00; H05H 7/00; H05H 7/04; H05H 7/08; H05H 7/10; H05H 13/00;
(Continued)

(56) References Cited

U.S. PATENT DOCUMENTS 8,941,336 B1 1/2015 Liu et al.
9,448,492 B2 9/2016 Yakunin et al.
(Continued)

FOREIGN PATENT DOCUMENTS

CN 101581867 A 11/2009
JP 10233300 A * 9/1998
(Continued)

OTHER PUBLICATIONS

Couprie, Marie-Emmanuelle, et al; "X radiation sources based on accelerators"; Comptes Rendus-Physique, May 22, 2018; pp. 487-506; vol. 9; No. 5-6; Elsevier; Paris, FR; ; XP022701295; ISSN: 1631-0705, DOI:10.1016/J.CRHY.2008.04.001.
(Continued)

*Primary Examiner* — David E Smith
(74) *Attorney, Agent, or Firm* — Laurence Greenberg; Werner Stemer; Ralph Locher

(57) ABSTRACT

A compact light source based on electron beam accelerator technology includes a storage ring, a booster ring, a linear accelerator and an undulator for providing light having the characteristics for actinic mask inspection at 13.5 nm. The booster ring and the storage ring are located at different levels in a concentric top view arrangement in order to keep the required floor space small and to reduce interference effects. Quasi-continuous injection by enhanced top-up
(Continued)

injection leads to high intensity stability and combats lifetime reductions due to elastic beam gas scattering and Touschek scattering. Injection into the storage ring and extraction from the booster ring are performed diagonal in the plane which is defined by the parallel straight section orbits of the booster ring and the storage ring. For the top-up injection from the booster ring into the storage ring two antisymmetrically arranged Lambertson septa are used.

5 Claims, 3 Drawing Sheets

(51) Int. Cl.
*H05H 7/10* (2006.01)
*H05H 13/04* (2006.01)
*H05H 7/04* (2006.01)

(58) Field of Classification Search
CPC .... H05H 13/02; H05H 13/041; H05H 13/043; H05H 13/045; H05H 13/046; H05H 13/048; H05H 13/04
See application file for complete search history.

(56) References Cited

U.S. PATENT DOCUMENTS

| | | | | |
|---|---|---|---|---|
| 2010/0092880 | A1* | 4/2010 | Melvin, III ..... | G03B 27/42<br>430/30 |
| 2014/0048707 | A1* | 2/2014 | Liu ..... | H05H 13/04<br>250/310 |

FOREIGN PATENT DOCUMENTS

| | | | |
|---|---|---|---|
| JP | H10233300 | A | 9/1998 |
| JP | 3219376 | B2 | 10/2001 |
| TW | 201250397 | A | 12/2012 |
| TW | 201415172 | A | 4/2014 |

OTHER PUBLICATIONS

Ockwell, D.C. et al; "Synchrotron light as a source for extreme ultraviolet lithography"; Journal of Vacuum Science & Technology B: Microelectronics Processing and Phenomena; Nov./Dec. 1999; pp. 3043-3046; vol. 17; No. 6.; American Vacuum Society, New York, NY, US.

* cited by examiner

COMPACT LIGHT SOURCE FOR METROLOGY APPLICATIONS IN THE EUV RANGE

BACKGROUND OF THE INVENTION

Field of the Invention

The present invention relates to a compact light source based on accelerator technology for metrology application in the EUV range, in particular optimized for actinic mask inspection using coherent scattering methods.

Metrology with available technologies is becoming increasingly challenging. On-wafer metrology, i.e. metrology of nanostructures ranging from thin films, patterned photoresists to integrated devices, is essential to monitor and control structural parameters such as CD (critical dimension, i.e. line width), LER (line-edge roughness), height, surface roughness, defects, thickness, sidewall angle, material composition, and overlay errors. In addition to electron microscopy, optical metrology (imaging, scattering, and ellipsometry) is extensively used. Optical scatterometry measures the spectral changes in intensity to determine the CD. Ellipsometry measures thickness and composition. X-ray metrology is used for coarse features of 2.5D and 3D architectures.

With shrinking dimensions and the introduction of FinFETs (i.e. tall structures) the methods are being stretched to their limits. The current strategy of the industry is the hybrid metrology flow and exhaustive modeling. For further progress, novel and disruptive approaches are needed. For future materials (e.g. graphene) the industry lacks metrology solutions. Directed self-assembly (DSA), a very promising technology, needs overlay metrology due to its randomness for which new solutions are needed. Thus, the future progress can very likely be hindered by the "metrology gap."

Extreme ultraviolet lithography (EUVL) is considered to be the most viable cost-effective next generation lithography for sub-22 nm HP (sub 7 nm technology node) for high-volume manufacturing of semiconductor devices. EUVL is based on reflective optical components for both the projection optics and the mask.

The large step from state-of-the-art 193 nm (ArF) optical lithography to 13.5 nm EUV lithography was triggered by the availability of optical elements for the EUV wavelength range. In comparison to the 193 nm range, where refractive optics is used for the manipulation of the photon beam, only reflective optics is available for the EUV range. Mo—Si coatings with 70% reflectivity and 2% BW at 13.5 nm wavelength are the adopted technologies for both mirrors and masks. These multilayers add another complication to the process. Stringent requirements exist on the flatness of the optics and the mask.

EUV masks consist of a substrate, multilayer coating on the substrate, and absorbing structures (e.g. TaN) patterned on the multilayer, where all these layers can have some defects which need to be detected and characterized in order to discard the mask or to repair the isolated defects before their use in the scanner. Therefore, EUV mask inspection tools become critical elements, especially also the detection of phase errors generated by deep inside located distortions in the multilayer mirror is important. Mask inspection is needed on blank multilayers and on patterned masks and the final mask through the pellicle.

Although other metrology methods, such as UV microscopy, AFM, SEM, are used for this purpose, actinic mask inspection, i.e. metrology with EUV light, has turned out to be an indispensable method. Only EUV light penetrates deeply into the resonant multilayer structure. State of the art is the SEMATECH Actinic Inspection Tool (SHARP), a high resolution EUV Fresnel zone plate microscope dedicated to photo mask research. Commercial mask review tools have been developed by Carl Zeiss, i.e. the AIMS tool. Other mask inspection tools are under development by some industrial companies such as KLA Tencor, which has been terminated according to the official statements of the company.

In addition to the lens-based methods mentioned above, lensless methods, such as coherent scattering (diffraction) methods and coherent scattering imaging, have been demonstrated to be feasible for actinic mask inspection. These methods do not rely on expensive optics and has also other advantages for defect inspection or imaging using phase-retrieval algorithms.

One of the major challenges for EUV metrology is to find an EUV source of high brightness and high stability. EUV light can be obtained through the spontaneous emission from a high-temperature and high-density plasma by Discharge Plasma Production (DPP) or Laser Plasma Production (LPP). Although for the scanners LPP sources above 100 W are under development and seem feasible, using a similar scheme and smaller droplets to achieve higher brightness with much less power is extremely difficult. The stability, up-time and debris are the most critical issues. High-harmonic generation (HHG) sources are also available. The problems of these highly coherent sources are stability and power. In summary, in order to scan a photomask within a reasonable time, DPP and LPP sources are limited by brightness (<100 $W/mm^2/srd$) and stability. The quoted brightness is sufficient for scanning microscopy. These sources are not suitable for coherent scattering methods, which require significantly higher brightness and coherence. HHG sources have very high brightness (coherence) but the flux becomes the bottleneck which is in the μW range. These sources are feasible for coherent scattering methods but for mask inspection within a reasonable time the flux should be more than 10 mW. Therefore they are not useful for use in photomask metrology within the targeted specifications of the industry. Mask metrology (i.e. mask inspection for localization of defects with low resolution and high throughput and mask review for characterization of defects with low speed and high resolution) is of critical importance to enable future progress. In particular, EUV lithography requires a reflective imaging technology for assessment of the defects of masks. Particularly the defects that are within or under the multilayers are not possible to detect with conventional methods. Therefore, actinic metrology, i.e. inspection and review with EUV light at 13.5 nm (92 eV) and reflection at 6° incidence angle (illumination conditions in manufacturing), is considered as indispensable. Thus, EUV mask metrology is in crisis for both review and inspection and immediate solutions are needed.

For both on-wafer and mask metrology methods, including but not limited to optical full-field imaging, scanning microscopy, scattering, coherent scattering, and coherent diffraction imaging, using short wavelengths, i.e. EUV light with the wavelength of 30 nm-6 nm can be a solution. However, these methods need light sources, which satisfy the requirements of the optical methods. The major challenges of state-of-the-art light sources, such as high-harmonic generation and said laser assisted plasma sources are high brightness and coherence, stability and flux, as well as a reasonable size and high operational reliability. Low installation costs and low maintenance costs are of course also issues.

Although there have been many systems proposed or manufactured that satisfy some of the features above, there is no system that satisfies all the features above.

Accelerator-based light sources, such as storage rings and free-electron lasers can provide high flux and coherence and are used world-wide for various applications, including mask inspection. Their drawback is that they are relatively large in size. Compact synchrotrons are also proposed and several of them have been manufactured in the past decade. For instance, so far the generation of EUV light from either bending magnets or wigglers (see for example U.S. Pat. No. 8,749,179 B1) has been proposed. Both of them are emitting light with relatively low brightness and with a broad spectrum from which the required wavelength has to be filtered out. Moreover, the intensity is not constant due to the long intervals of injection and decay of electron beam in the storage ring. In addition, the design does not put emphasize on reducing the total footprint of the tool. Most importantly, such a tool satisfies the requirements of the EUV actinic mask metrology using lens-based methods. It provides sufficient brightness needed for scanning microscopy and full-field imaging. The variation of the beam intensity is corrected by adjusting the scanning speed or controlling the attenuation of the beam intensity. However, such a source does not provide the very high brightness and coherence required for coherent scattering methods. Moreover, the change of the photon intensity will change the heat load on the mirrors which leads to instabilities of the beam position. For coherent scattering imaging, beam stability requirements are extremely critical.

SUMMARY OF THE INVENTION

It is therefore the objective of the present invention to provide a compact and cost effective light source based on a storage ring that can deliver sufficient power, stability, brightness and coherence for metrology methods in the EUV range, in particular but not limited to, coherent scattering methods.

This objective is achieved according to the present invention by a compact light source based on electron beam accelerator technology, comprising a storage ring, a booster ring, a linear accelerators and an undulator for providing light having the characteristics for actinic mask inspection at 13.5 nm, wherein:

a) the intensity of the electron beam is maintained down to a level of $10^{-3}$;

b) a compact multi-bend magnet structure is used for the storage ring to generate a small emittance leading to high brilliance and large coherent content of the light;

c) the booster ring and the storage ring are located at different levels in a concentric top view arrangement in order to keep the required floor space small and to reduce interference effects;

d) quasi-continuous injection, respectively enhanced top-up injection is implemented to reach the high intensity stability and to combat lifetime reductions due to elastic beam gas scattering and Touschek scattering;

e) the injection into the storage ring and extraction from the booster ring are performed diagonal in the plane which is defined by the parallel straight section orbits of the booster ring and the storage ring; and f) for the top-up injection from the booster ring into the storage ring two antisymmetrically arranged Lambertson septa are used.

These measures result in a sufficiently compact source that fits into conventional labs or their maintenance areas and that is designed for low maintenance requirements and low cost of ownership. The wavelength of the light emitted by the undulator ranges from 6 to 30 nm. The light beam has an extreme stability in the range of $10^{-3}$, a sufficient central cone power in a range larger than 100 mW and a high brightness larger than 100 kW/mm$^2$/sr at the source level in which the transfer optics delivers at least 10% of the beam on the mask level. These values are based on the use of coherent scattering methods and scanning of a 100 cm$^2$ field area of a photomask within a reasonable time. The flux requirement for mask review and coherence requirement for lens-based metrology methods are lower than these specifications and therefore also feasible with this method.

The parameter space of electron beam energy, undulator period length, number of undulator periods has therefore been optimized to provide the required wavelength and photon flux for metrology applications with minimum costs and space requirements. No other compact source has proposed the concentric ring concept to realize the beam stability and compactness simultaneously.

In order to fit into conventional labs and their maintenance areas, the architecture is designed to have a footprint being about 50 m$^2$.

This extremely small footprint for a racetrack design with 2 long straight sections is achieved by a 3-dimensional arrangement of storage ring, booster and linear accelerator. This measure also alleviates the electromagnetic disturbances of the booster ring on the storage ring beam. Moreover, small multi-functional magnets are building up the structures of the storage ring and the booster ring.

Based on the resulting straight section length for the undulator an optimum layout of the storage ring has been created which respects the technical boundaries for the maximum possible magnetic fields of bending magnets and quadrupoles and the engineering space requirements.

As a novelty for a compact source, the present invention comprises the full energy booster synchrotron ring for quasi-continuous, respectively enhanced top-up injection into the storage ring. Top-up injection is not only mandatory to reach the required intensity stability but also to combat lifetime reductions due to Touschek scattering and elastic beam gas scattering. Both, the low energy of the electron beam and the small vertical aperture gap of the undulator strongly enhance these effects.

Injection into the storage ring and extraction from the booster synchrotron ring are performed in the tilted plane which is defined by the parallel straight section orbits of the booster ring and the storage ring. For the injection into the storage ring, a pulsed multipole system is used which leaves the stored beam unaffected during the injection process. No gaps are needed in the ring filling for kicker rise and fall times which increases the homogeneity of the filling and reduces for a fixed total current the charge per bunch and alleviates therefore collective effects, thus further improving the source stability.

The linear accelerator (Linac) fits fully within the structure of the storage ring. This measure also clearly contributes to the demand of reducing the footprint of the source.

Therefore, the light source according to the present invention is the first EUV source with extremely high intensity stability, as required for coherent diffraction imaging (CDI).

Further preferred embodiments of the present invention are listed in the depending claims.

BRIEF DESCRIPTION OF THE SEVERAL VIEWS OF THE DRAWING

Preferred embodiments of the present invention are hereinafter described with reference to the attached drawings which depict in:

FIG. 4 3D-integration view of the compact light according to FIG. 3.

DESCRIPTION OF THE INVENTION

For a better understanding of the technical background, the photon beam requirements for actinic mask inspection with CDI are explained first.

A verification of the principle of mask inspection using CDI has been performed at the XIL-II beamline at the SLS (Swiss Light Source at Paul Scherrer Institute, 5232 Villigen PSI, Switzerland). The photon beam requirements for an actinic mask inspection tool based on CDI are collected in Tab. 1. It has to be noted that these values are rough estimations. A more precise estimate of the requirements needs a conceptual design of the complete system with its optics, measurement methods, reconstruction algorithms and detector specifications. Moreover, a very likely scenario is that a single source serves multiple tools simultaneously. Currently, the best option could be to use a single undulator and distribute the beam with beam splitters.

TABLE 1

Photon beam requirements for actinic mask inspection with CDI on the mask level

| Parameter | Unit | Value |
|---|---|---|
| Wavelength | nm | 13.5 |
| Central cone power | mW | >10 |
| Brightness | kW/mm$^2$/sr | >10 |
| Beam stability | | $10^{-3}$ |
| Spot size | μm | 10-100 |
| Bandwidth (temporal coherence) | % | 2-0.1 |

Based on the requirements for actinic mask inspection with CDI at a wavelength of 13.5 nm a first optimization of the source parameters—undulator and compact storage ring were performed. The calculations are based on the flux requirement of $1.3\times10^{15}$ photons per second in 0.1% bandwidth.

The relevant relations for the compact light source are:

$$\lambda = \frac{\lambda_u}{2\gamma^2}\left(1 + \frac{K^2}{2}\right) \tag{1}$$

$$\gamma = \frac{E[\text{MeV}]}{0.511} \tag{2}$$

$$\frac{\dot{N}}{0.1\%\ BW} = n_0 = 1.43.10^{11}\ N_u I[\text{mA}]\frac{K^2}{1 + K^2/2} \tag{3}$$

$$K = 0.934.\lambda_u[\text{cm}]B_u[T] \tag{4}$$

wherein λ stands for the wavelength of the emitted light; $\lambda_u$ is the period length of the undulator, γ is the Lorentz factor as defined by (2), $n_0$ is the number of photons per second in 0.1% of the bandwidth as defined by (3) and K is the undulator parameter as defined by (4). $N_u$ stands for the number of undulator periods, while I is the current of the electron beam.

Figure 1:
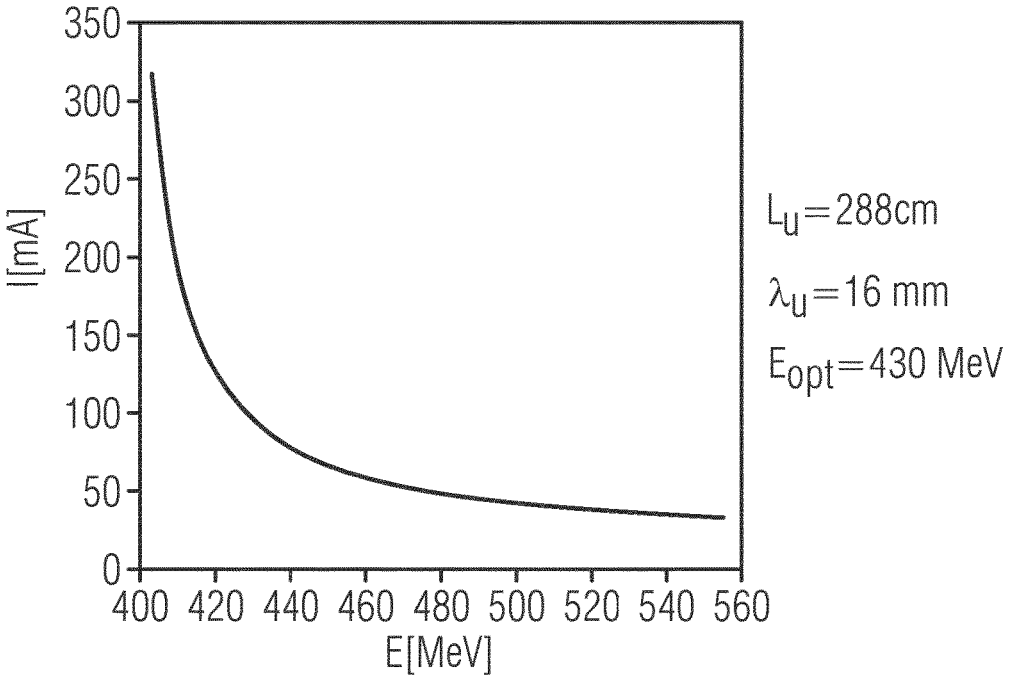
FIG. 1 as an example the variation of the beam current as a function of the electron energy for an undulator with 200 periods of 16 mm length.

FIG. 1 shows the variation of the beam current as a function of the electron energy if conditions (1) and (3) are fulfilled, for an undulator period length $\lambda_u$ of 16 mm, which has been chosen as conservative value. If K approaches 0, the beam current I goes to infinity in order to fulfill condition (1). But at a rather modest distance from this pole a reasonable current can be reached. For the considerations here the energy was chosen as 430 MeV. There is not much gain in current reduction above this energy limit.

Figure 2:
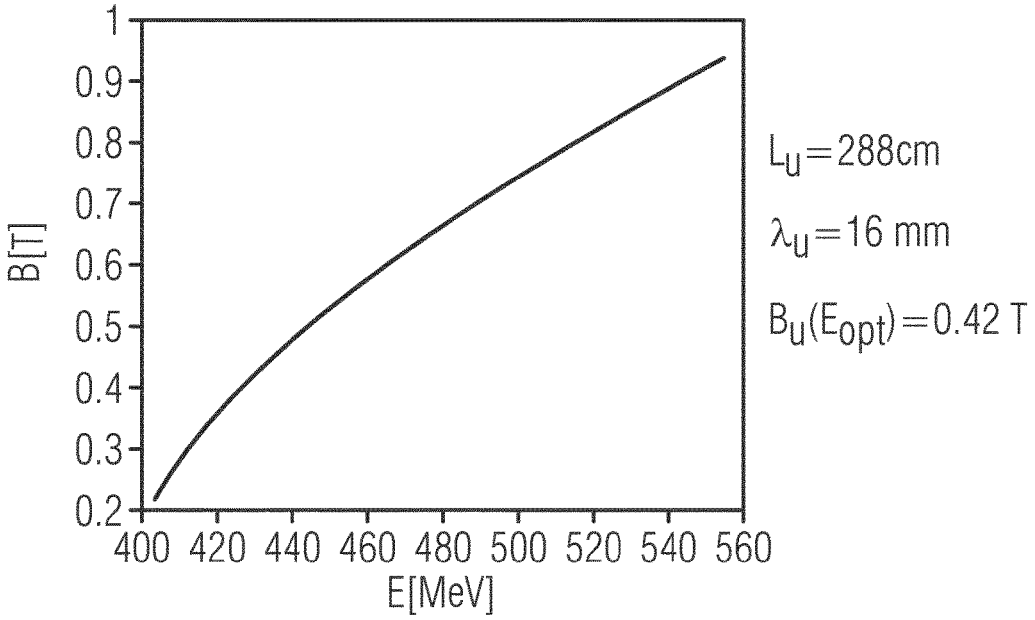
FIG. 2 the related magnetic field for the same range of electron energy.

FIG. 2 shows the related magnetic field B for the same range of electron energy (as in FIG. 1).

In conclusion: For the development of the source concept, an undulator period length of 16 mm has been chosen. All the other parameters are a consequence of this choice. The energy of the compact storage ring results in 430 MeV and the undulator field in 0.42 T.

There are some technical limits for undulators with short period lengths and high fields. An undulator period length of 16 mm is at the limit for what can be conventionally reached today. An even shorter period length would have the advantage of lower beam energy as it is evident from equation (1) but requires on the other hand higher undulator field strengths to achieve a reasonable large K parameter (4). And if the K parameter is too low, higher beam currents are needed to reach the required flux defined by equation (3).

Cryo undulators would allow even shorter period lengths combined with higher fields but they add a complexity which would affect the reliability and are therefore not considered here.

The required number of photons can be reached with 150 mA beam current. This is sufficiently low in order to avoid harmful collective effects. In conclusion, the energy of 430 MeV is reasonably small to allow a compact storage ring. The field of 0.42 T for the undulator is well within the actual standards. The K value is 0.63 and consequently small enough to not enhance the higher harmonics.

The selected parameters of the undulator and the electron beam are summarized in Tab.2.

TABLE 2

Undulator and electron beam parameters

| | |
|---|---|
| Resonance wavelength [nm] | 13.5 |
| Undulator length [cm] | 320 |
| Undulator period length [mm] | 16 |
| Undulator magnetic field [T] | 0.42 |
| K-value | 0.63 |
| Energy [MeV] | 430 |
| Beam current [mA] | 150 |

CDI methods ask for a high intensity stability of the electron beam which makes top-up injection mandatory. An enhanced top-up injection or quasi-continuous injection becomes necessary in order to combat lifetime reductions due to elastic beam-gas scattering and Touschek scattering. Both are strongly enhanced by the low storage ring energy combined with the small undulator gap.

Figure 3:
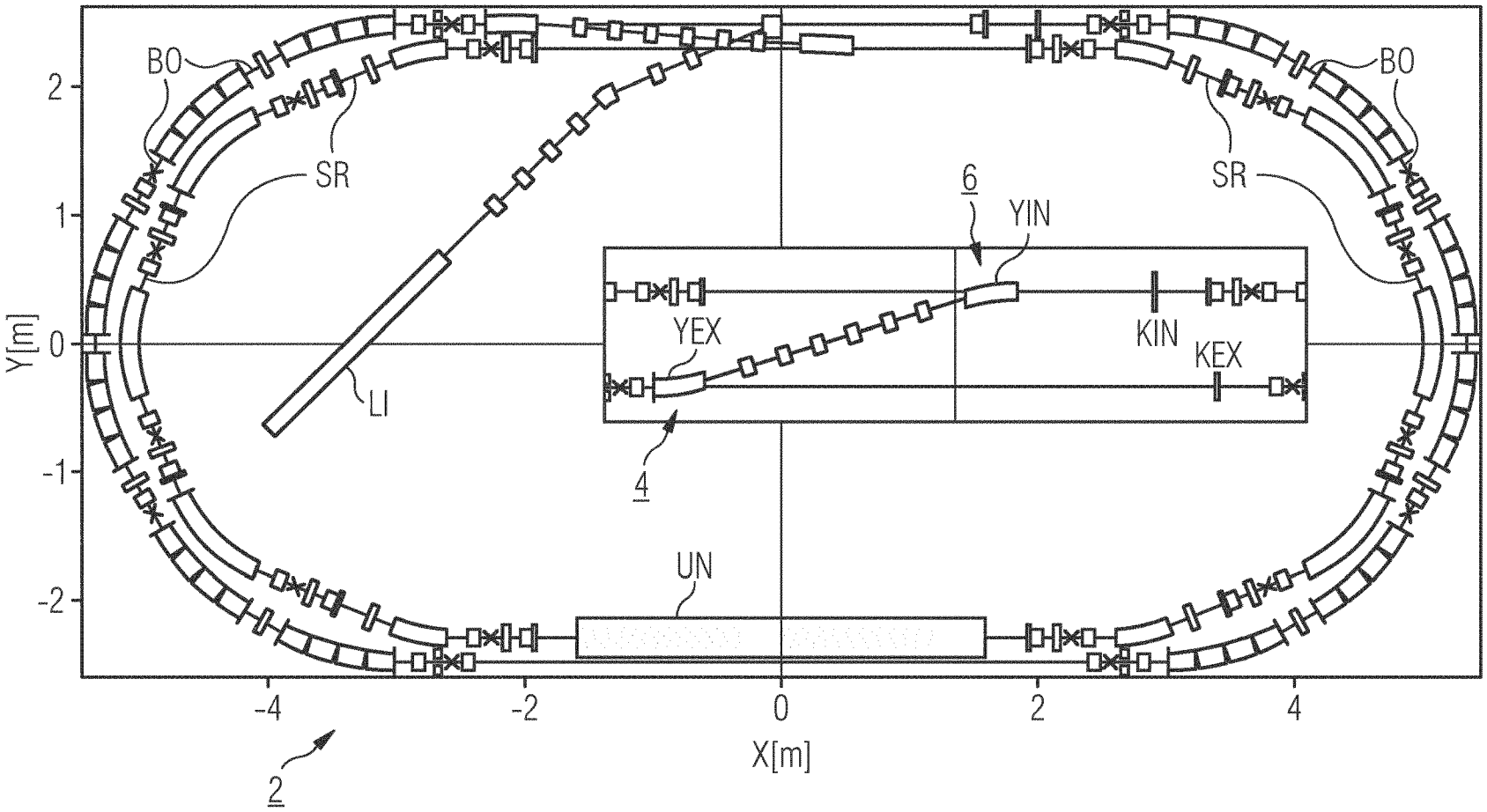
FIG. 3 schematically the baseline design of a compact light source for providing light having the characteristics for actinic mask inspection.
Figure 4:
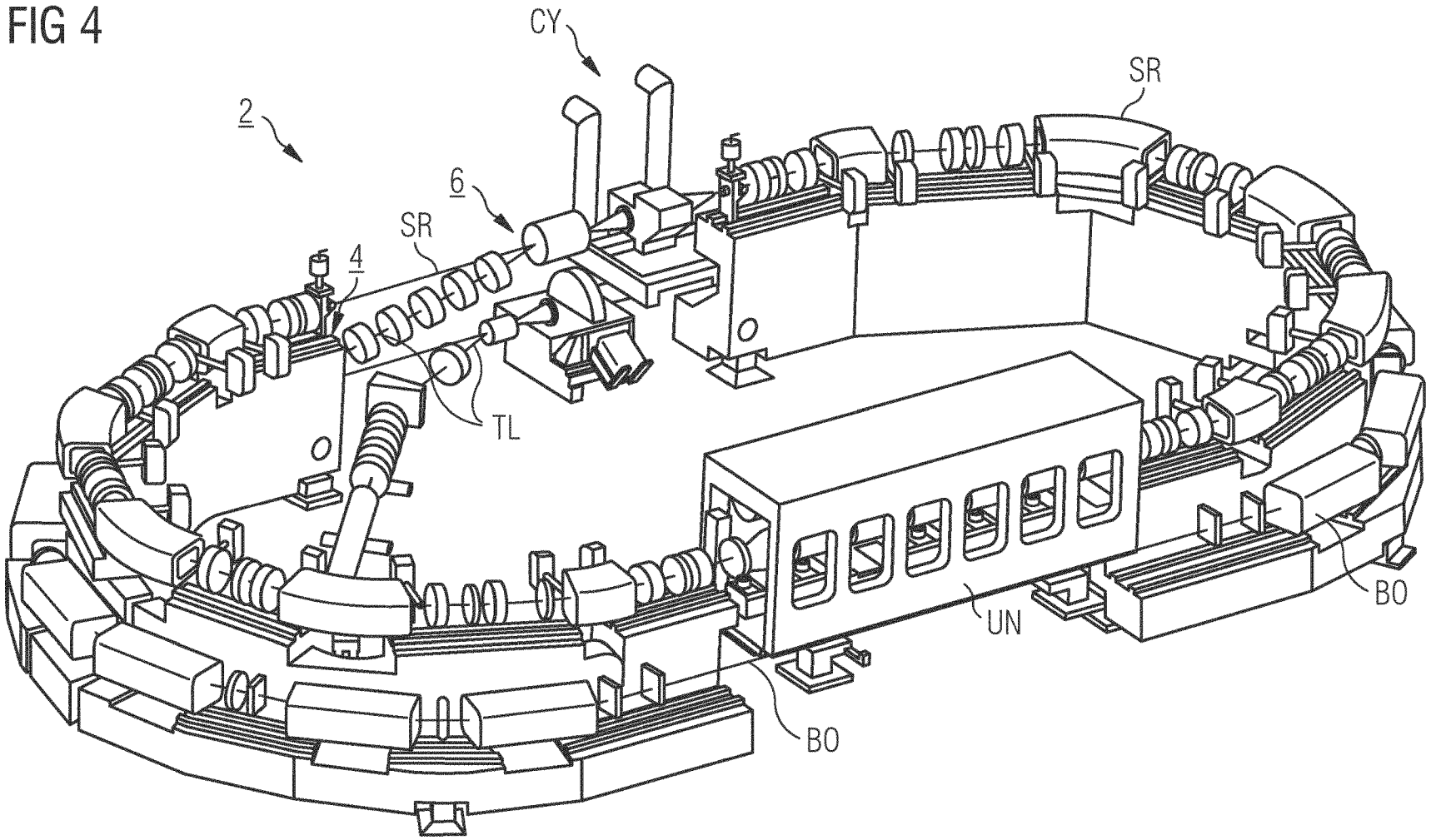

FIG. 3 schematically shows schematically a top-view on a compact light source 2 for providing light having the characteristics for actinic mask inspection at 13.5 nm. Of course, by adapting the design of the specific components the emitted light can have other dominant wavelengths. The compact light source 2 comprises a storage ring SR, a concentric booster synchrotron BO and a linear pre-accelerator LI. In FIG. 3 also included is a schematic side view of a booster extraction scheme 4 and a storage ring injection scheme 6 with two antisymmetrically arranged Lambertson septa YEX, YIN. YEX marks an extraction septum, YIN an injection septum, KEX represents an extraction kicker and KIN a nonlinear injection kicker. FIG. 4 schematically shows a 3D-view of the compact light source 2 with the storage ring SR, the booster synchrotron BO and the linear pre-accelerator LI with transfer lines TL, an undulator UN and acceleration cavities CY.

The design of the booster synchroton BO follows the racetrack shape of the storage ring SR. Since the required floor space should be minimum, the booster synchroton BO as shown in FIG. 3 and FIG. 4 is placed concentrically below the storage ring SR with minimum lateral spacing in order to facilitate the beam transfer and large vertical spacing in order to maximize the separation between the booster synchroton BO and the storage ring SR. This will alleviate the electromagnetic disturbances of the cycling booster synchroton BO on the electron beam in the storage ring SR.

The tilted extraction and injection systems 4, 6 are built up by two antisymmetrically arranged Lambertson septa YEX, YIN that are connecting the two straight sections of the booster synchroton BO and the storage ring SR. The electron beam is horizontally displaced in both septa YEX, YIN and gets deflected vertically. From the storage ring injection septum YIN it is guided with a small slope to the multipole injection kicker KIN where it is captured inside the storage ring acceptance.

The innovative features of this compact light source 2 presented above, especially the combination of all of them, have never been applied to a compact low energy storage ring based light source. For the solution presented here, all intrinsic problems of such a complex system have been solved.

For the undulator UN, permanent magnet material Dy enhanced NdFeB was selected which provides a remanent field of $B_r$=1.25 T. With an enhanced material—compared to the U15 undulator at the SLS (block height from 16.5 to 26.5 mm and pole width from 20 to 30 mm)—a field of B=0.47 T can be reached with 8.5 mm gap and B=0.42 T with 9 mm. Tab. 3 below summarizes the major beam parameters, the source parameters and the light characteristics.

TABLE 3

Beam parameters, source parameters and light characteristics of COSAMI (Compact EUV Source for Actinic Mask Inspection) for actinic mask inspection.

| | | |
|---|---|---|
| Beam parameters: | | |
| Beam energy | MeV | 430 |
| Beam current | mA | 150 |
| Horizontal emittance+) | nm | 9.2 |
| Emittance coupling | | 0.01 |
| U-optics parameters: | | |
| $\beta_x/\beta_y$ | m/m | 0.43/1.17 |
| $\sigma_x/\sigma'_x$ | μm/μrad | 79.1/116.4 |
| $\sigma_y/\sigma'_y$ | μm/μrad | 8.3/11.2 |
| Source parameters: | | |
| U-length | m | 3.2 |
| Period length | mm | 16.0 |
| Number of periods | $N_u$ | 200 |
| Peak field | T | 0.42 |
| K-value | | 0.624 |
| Light characteristics: | | |
| Resonance wavelength | nm | 13.5 |

TABLE 3-continued

Beam parameters, source parameters and light characteristics of COSAMI (Compact EUV Source for Actinic Mask Inspection) for actinic mask inspection.

| | | |
|---|---|---|
| Diffractive emittance | nm | 1.07 |
| Diffractive beam sizes: | | |
| $\sigma_r/\sigma'_r$ | μm/urad | 23.4/45.9 |
| Central cone power | mW | 103.1 |
| Flux | ph/s/0.1% BW | $1.28 \times 10^{15}$ |
| Brilliance | ph/s/mm$^2$/mrad$^2$/0.1% BW | $2.64 \times 10^{18}$ |
| Coherent Brilliance | ph/s/mm$^2$/mrad$^2$/0.1% BW | $2.82 \times 10^{19}$ |
| Coherent fraction | % | 9.4 |

+)Intra-Beam-Scattering blow up included

REFERENCES

[1] A. Wrulich et al, Feasibility Study for COSAMI—a Compact EUV Source for Actinic Mask Inspection with coherent diffraction imaging methods

[2] A. Streun, OPA, http://ados.web.psi.ch/opa/

[3] A. Streun: "COSAMI lattices: ring, booster and transfer line", Internal note, PSI Jun. 28, 2016.

The invention claimed is:

1. A compact light source based on electron beam accelerator technology, the compact light source comprising:

a storage ring being a compact multi-bend magnet structure configured to generate a small emittance leading to high brilliance and large coherent content of the light;

a booster ring disposed at a different level from said storage ring in a concentric top view arrangement in order to keep a required floor space small and to reduce interference effects;

a linear accelerator and an undulator for providing light having the characteristics for actinic mask inspection at 13.5 nm; and two antisymmetrically arranged Lambertson septa for a top-up injection from said booster ring into said storage ring;

wherein an intensity of an electron beam is maintained down to a level of $10^{-3}$ and wherein quasi-continuous injection, respectively enhanced top-up injection is implemented to reach a high intensity stability and to combat lifetime reductions due to elastic beam gas scattering and Touschek scattering;

wherein injection into said storage ring and extraction from said booster ring are effected diagonally in a plane defined by parallel straight section orbits of said booster ring and said storage ring.

2. The compact light source according to claim 1, wherein said booster ring and said storage ring are concentrically arranged with small lateral displacement to facilitate a beam transfer and larger vertical displacement to reduce interference effects.

3. The compact light source according to claim 1, which comprises a multipole kicker for an enhanced top-up injection into said storage ring to avoid a gap in a ring filling, in order to reduce a bunch current and to achieve a required high intensity and position stability.

4. The compact light source according to claim 1, wherein:

said storage ring, said booster ring and said linear accelerator are disposed in a 3-dimensional arrangement within a footprint of approximately 50 m$^2$ in total and forming a racetrack design with two long straight sections;

said storage ring and said booster ring having multi-functional magnets and wherein a compact dispersion suppressing beam transfer from said booster ring to said storage ring is effected with two antisymmetrically arranged Lambertson septa, and by performing the injection into said storage ring by a single nonlinear kicker only.

5. The compact light source according to claim 1, wherein:

a) said storage ring is disposed to receive accelerated electrons from said booster ring via enhanced top-up injection, keeping a beam intensity stable to a level of $10^{-3}$ and combatting lifetime reductions caused by the low energy storage ring combined with said low gap undulator, wherein an electron energy of the electron beam in said storage ring ranges from 200 to 500 MeV and a current of the electron beam ranges from a lower value to 200 mA;

b) said booster ring is configured for enhanced top-up injection receiving the accelerated electrons via an injection pathway from said linear accelerator;

c) said booster and storage rings are concentrically arranged, with only a slight lateral displacement in order to facilitate the beam transfer and a large vertical displacement in order to minimize an interference effect of the cycling booster on the electron beam in said storage ring and enabling an extremely compact source without compromising a beam stability and machine reliability;

d) said low gap undulator is integrated in the storage ring, said undulator having an undulator period of 8 to 24 mm and a length of a large multiple of the undulator period.

* * * * *